US007924981B2

(12) United States Patent
Iijima et al.

(10) Patent No.: US 7,924,981 B2
(45) Date of Patent: Apr. 12, 2011

(54) X-RAY GENERATOR

(75) Inventors: Hirokazu Iijima, Tokyo (JP); Jun Takahashi, Tokyo (JP)

(73) Assignee: Hitachi Medical Corporation, Tokyo (JP)

( * ) Notice: Subject to any disclaimer, the term of this patent is extended or adjusted under 35 U.S.C. 154(b) by 41 days.

(21) Appl. No.: 12/444,766

(22) PCT Filed: Aug. 30, 2007

(86) PCT No.: PCT/JP2007/066933
§ 371 (c)(1),
(2), (4) Date: Apr. 8, 2009

(87) PCT Pub. No.: WO2008/050540
PCT Pub. Date: May 2, 2008

(65) Prior Publication Data

US 2009/0316859 A1 Dec. 24, 2009

(30) Foreign Application Priority Data

Oct. 25, 2006 (JP) ..... 2006-289508

(51) Int. Cl.
*H05G 1/34* (2006.01)

(52) U.S. Cl. ..... 378/110

(58) Field of Classification Search ..... 378/110–119
See application file for complete search history.

(56) References Cited

U.S. PATENT DOCUMENTS

| | | | | |
|---|---|---|---|---|
| 4,646,338 | A | 2/1987 | Skillicorn | |
| 5,056,125 | A * | 10/1991 | Beland | 378/101 |
| 6,449,337 | B1 | 9/2002 | Honda et al. | |
| 2006/0210020 | A1 | 9/2006 | Takahashi et al. | |

FOREIGN PATENT DOCUMENTS

| | | |
|---|---|---|
| JP | 8-213188 | 8/1996 |
| JP | 2000-215997 | 8/2000 |
| JP | 2001-145625 | 5/2001 |
| JP | 2004-342360 | 12/2004 |
| WO | WO2004/103033 A1 | 11/2004 |

OTHER PUBLICATIONS

May 7, 2010 European search report in connection with a counterpart European patent application No. 07806410.

* cited by examiner

*Primary Examiner* — Irakli Kiknadze
(74) *Attorney, Agent, or Firm* — Cooper & Dunham LLP

(57) ABSTRACT

A discharging part of an X-ray generator using a one-side earthed X-ray tube is earthed is identified on the basis of the tube voltage detected value and the tube current detected value. For the identification, the X-ray generator comprises a device comprising tube voltage decrease slope calculating means (S4), tube current increase calculating means (S4), first judging means (S5) for judging whether or not the slope of the tube voltage decrease exceeds its acceptable value, second judging means (S6) for judging whether or not the increase of the tube current exceeds its acceptable value, and discharge portion identifying means (S7, S8) for identifying the discharging part which is in the X-ray tube or a high-voltage generating unit on the basis of the results of the judgments made by the first and second judging means. The identified discharging part is displayed on display means (S9).

15 Claims, 12 Drawing Sheets

X-RAY GENERATOR

CROSS-REFERENCE TO RELATED APPLICATIONS

This application is a Section 371 national stage of International Application No. PCT/JP2007/066933 filed Aug. 30, 2007.

TECHNICAL FIELD

This disclosure relates to an X-ray generator used in an X-ray CT apparatus, particularly to an X-ray generator having a function to identify a discharging part in a high voltage unit including an X-ray tube which is one-side earthed type wherein the anode or cathode is earthed.

BACKGROUND

In recent years, the helical scan CT apparatus comprising the multi-slice function capable of imaging multiple slices of tomographic images at once over a wide range in a short time made possible by a multiseriate function in an X-ray detector has become a main stream in X-ray CT apparatuses. Such X-ray CT apparatuses have facilitated acquisition of continuous data in the body-axis direction of an object to be examined and construction of 3-dimensional images using the acquired data.

These helical scan CT apparatuses have an X-ray tube device including an X-ray tube and its attachments in a scanner rotation unit and an X-ray detector, capable of continuously rotating the scanner rotation unit while continuously moving a table on which the object is placed in the body-axis direction of the object. The helical scan CT apparatus is for relatively effecting helical movement of the X-ray tube device and the X-ray detector with respect to the object by continuous rotation of the scanner rotation unit and continuous movement of the table.

Since the helical scan CT apparatus must continuously irradiate X-rays to the object for a long time from the X-ray tube device installed in the scanner rotation unit, the load on the X-ray tube device increases. When the load increases the heat to be generated from the anode of the X-ray tube also increases, which raises the temperature inside of the X-ray tube.

When the temperature inside of the X-ray tube rises higher than a predetermined temperature, the anode of the X-ray tube needs to be cooled down to a predetermined temperature to prepare for the next imaging. This prolongs the waiting time until the next scanning which lowers the throughput of scanning. The time for cooling the X-ray tube device is more likely to be prolonged, since there is a demand for further improvement on CT image quality which increases the X-ray amount for irradiation.

In this way, improvement of imaging throughput and image quality is highly desired particularly in helical scan X-ray CT apparatuses, which demands large capacity function of the X-ray tube device.

While current of electricity between the anode and cathode of the X-ray tube (hereinafter referred to as tube current) can be increased when the X-ray tube has large capacity function, there is a need to take sufficient measures against discharging in the X-ray tube and the peripheral equipment. Identifying a discharging part is crucial for taking appropriate countermeasure against the problem of discharge.

Given this factor, it is important to identify where in a high-voltage generating device, X-ray tube and high-voltage cable a discharge occurred in order to cope with the problem appropriately. As for the technique for identifying a discharging part, the following technique is disclosed in Patent Document 1. A first resistor for current detection is series-connected to the anode where the X-ray tube is earthed. A second resistor for current detection is series-connected also to the secondary side of the high-voltage generating device. Each output of the first and second resistors for current detection are compared with a predetermined threshold value in a comparison circuit. By such configuration, when a discharge occurs in the high-voltage unit, the portion where the discharge occurred is identified by differentiating the internal X-ray tube from the other part.

Patent Document 1: JP-A-2000-215997

However, in the technique disclosed in the Patent Document 1, when a discharge occurred in the X-ray tube, the space between the anode and cathode of the X-ray tube is short-circuited, and high voltage of direct current in the range of 50 kV~150 kV which is an output voltage of the high-voltage generating device is directly applied to the first and second resistors for current detection.

For this reason, in order to avoid damage of the first and second resistors for current detection, the resistors need to be formulated with high-voltage insulation to withstand high voltage. Also, the resistors for current detection have to bear a large amount of short-circuit current since resistance value of the resistors for current detection is very small. Therefore, the resistors for current detections turn out to be very large in size, which is a disadvantage for an X-ray CT apparatus where the size and weight of the resistors must be reduced to be mounted in the scanner rotation unit.

Also, there is a possibility that the anode itself of the anode-earthed X-ray tube becomes high potential with respect to the earth potential, which could cause the problem that the detection circuit becomes inoperative and identifying the discharging part becomes difficult. These problems are also common for the cathode-earthed X-ray tube.

BRIEF SUMMARY

In an aspect of this disclosure, there is provided a compact X-ray generator comprising a function for identifying a discharging part with high accuracy.

In another aspect, the X-ray generator comprises:

a one-side earthed X-ray tube wherein the anode or cathode is earthed; and high-voltage generating means for generating X-rays by applying DC high-voltage between the anode and cathode of the X-ray tube, characterized in further comprising:

tube voltage detecting means for detecting the tube voltage applied between the anode and cathode of the X-ray tube;

tube current detecting means for detecting the tube current that flows between the anode and cathode of the X-ray tube; and discharge portion identifying means for identifying where in the high-voltage generating means or the X-ray tube a discharge occurred based on the tube voltage detected value detected in the tube voltage detecting means and the tube current detected value detected in the tube current detecting means.

BRIEF DESCRIPTION OF THE DIAGRAMS

BEST MODE FOR CARRYING OUT THE INVENTION

Hereinafter, preferable embodiments of the X-ray generator related to the present invention will be described in detail referring to the attached diagrams.

In all of the diagrams below for illustrating embodiments of the present invention, the places having the same function will be appended with the same symbol, and the repeated explanation thereof will be omitted.

First Embodiment

Figure 1:
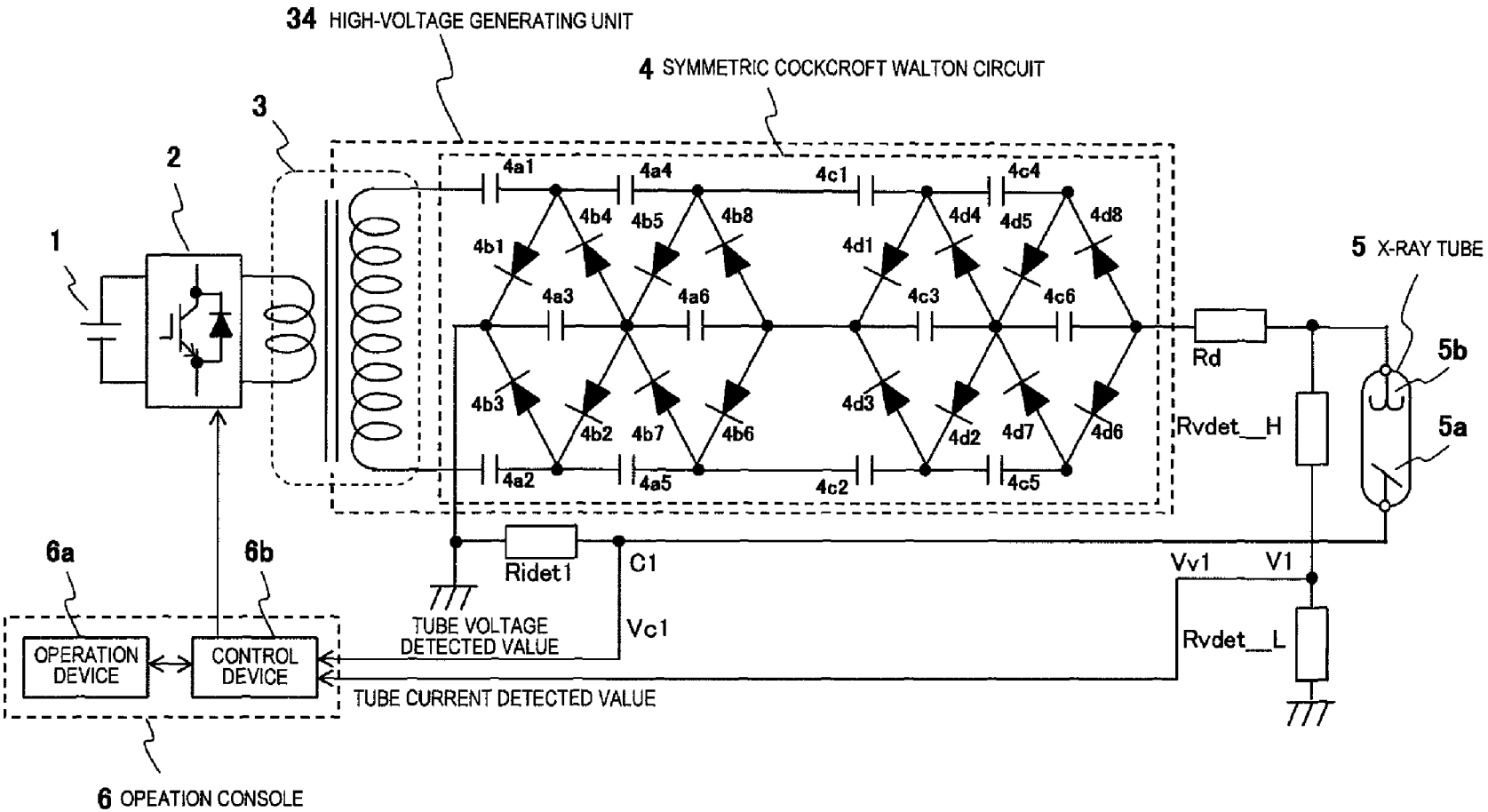
FIG. 1 is a circuitry diagram of the first embodiment of the X-ray generator related to the present invention using an anode-earthed type X-ray tube comprising a function for identifying a discharging part.

FIG. 1 is a circuitry diagram of the X-ray generator by the first embodiment of the present invention using an anode-earthed type X-ray tube comprising a function for identifying a discharging part.

The X-ray generator comprises:

a direct-current (DC) power source 1:

an inverter circuit 2 (DC/AC converting means) for converting voltage of the DC power source 1 into alternating voltage of a predetermined frequency;

a high-voltage transformer 3 for stepping up the alternating voltage of the inverter circuit 2;

a symmetric Cockcroft-Walton circuit 4 for converting voltage of the high-voltage transformer 3 into DC voltage by further stepping it voltage up to four-times the voltage thereof;

an anode-earthed type X-ray tube 5 wherein the anode 5*a* is earthed for generating X-rays by applying output voltage of the symmetric Cockcroft-Walton circuit 4 between an anode 6*a* and a cathode 6*b;* a discharge current suppressing resistor Rd connected between the symmetric Cockcroft-Walton circuit 4 and a cathode 5*b* of the X-ray tube 5 for suppressing the discharging current upon discharge of the X-ray tube 5;

a tube voltage dividing resistors Rvdet_H and Rvdet_L connected between the cathode 5*b* of the X-ray tube 5 and the earth, for dividing the tube voltage of the X-ray tube 5 to detect the voltage commensurate with the divided voltage;

a tube current detecting resistor Ridet1 connected between the anode 5*a* of the X-ray tube 5 and the earth; and an operation console 6 having an operation device 6*a* and a control device 6*b*. The control device 6*b* includes devices such as an X-ray control device for inputting Vv1 representing the tube voltage detected value detected in an end terminal V1 of the tube voltage detecting resistor Rvdet_L, Vc1 representing the tube current detected value detected in an end terminal C1 of the tube current detecting resistor Ridet1 and the X-ray condition (tube voltage, tube current and X-ray irradiation time) set in the operation device 6*a*, and controlling the output voltage of the inverter circuit 2 by controlling the conduction width of the electric power semiconductor switching element of the inverter circuit 2 and/or the operating frequency of the switching element to make it/them to satisfy the set X-ray condition.

The DC power source 1 may have any form such as a circuit form obtained by converting commercial power source voltage (not shown) into DC voltage, or a battery. Also, the circuit pattern for converting the commercial power source voltage into DC voltage may be any pattern such as performing full-wave rectification on the commercial power source voltage using a full-wave rectification circuit, adjusting the DC voltage obtained by the full-wave rectification by a chopper circuit or comprising a voltage control function in the full-wave rectification circuit.

The symmetric Cockcroft-Walton circuit 4 is high-voltage doubling means for converting the output voltage of the high-voltage transformer 3 into DC high-voltage using a capacitor and a diode standardized on the circuit disclosed in Patent Document WO2004/103033, and is configured by series-connecting each of the DC output from a first full-wave boost rectifier circuit formed by capacitors 4*a*1, 4*a*2 and 4*a*3 and diodes 4*b*1~4*b*4, a second full-wave boost rectifier circuit formed by capacitor 4*a*4, 4*a*5 and 4*a*6 and diodes 4*b*5~4*b*8, a third full-wave boost rectifier circuit formed by capacitors 4*c*1, 4*c*2 and 4*c*3 and diodes 4*d*1~4*d*4 and a fourth full-wave boost rectifier circuit formed by capacitors 4*c*4, 4*c*5 and 4*c*6 and diodes 4*d*5~4*d*8 (AC/DC converting means, a first capacitor and a second capacitor).

To such configured capacitors 4*a*3, 4*a*6, 4*c*3 and 4*c*6 of the first full-power boost rectifier circuit~fourth full-power boost rectifier circuit, the peak value of the output voltage from the respective full-power rectified high-voltage transformer 3 are charged. In this manner, the output voltage of the symmetric Cockcroft-Walton circuit 4 becomes the sum voltage of the output voltage from the first full-power boost rectifier circuit~fourth full-power boost rectifier circuit.

In other words, the peak value of the output voltage from the high-voltage transformer 3 is stepped up to four-times the voltage thereof.

In this way, the high-voltage generating unit 34 is formed by the high-voltage transformer 3 and the symmetric Cockcroft-Walton circuit 4. The high-frequency AC voltage converted by the inverter circuit 2 is stepped up to a predetermined tube voltage, for example, 150 kV and rectified in the high-voltage generating unit 34 which is high-voltage generating means.

The operation console 6 comprises an operation device 6*a* for setting operation condition such as X-ray condition provided with a display device for displaying the set operation condition, etc., and a control device 6*b* including an X-ray control unit 6*b*1 for controlling the tube voltage and tube current to be described later and a discharge detecting unit 6*b*2, which is a substantial part of the present invention, for detecting and identifying a discharging part of the high-voltage generating unit 34 and the anode-earthed type X-ray tube 5.

Figure 2:
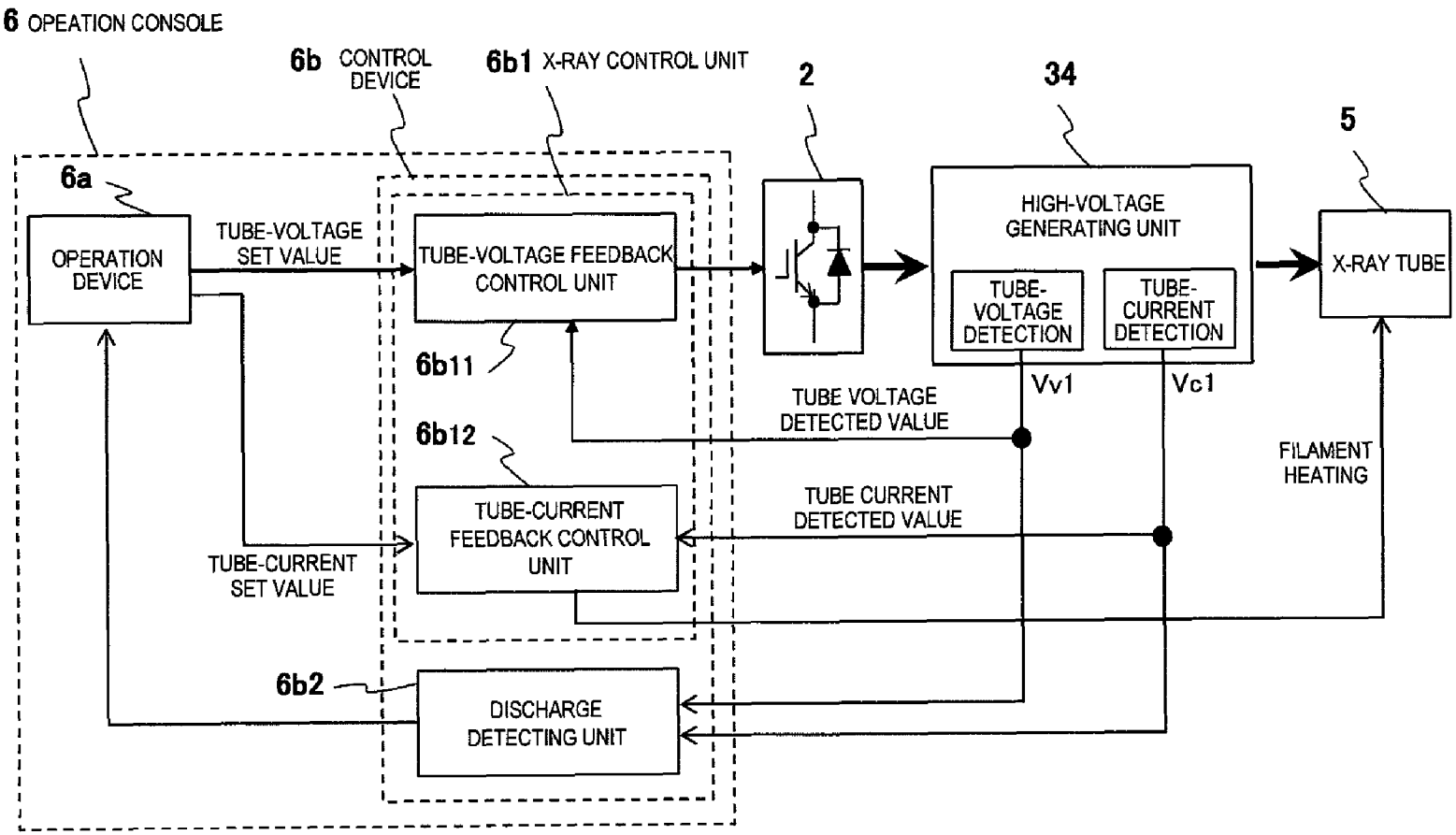
FIG. 2 shows a configuration of a control device in the X-ray generator of the first embodiment.

The X-ray control unit 6*b*1 comprises, as shown in FIG. 2, a tube voltage feedback control unit 6*b*11 for feedback-controlling tube voltage to make the tube voltage detected value Vv1 detected in the tube voltage detecting resistor Rvdet_L coincide with the tube voltage set value being set in the operation device 6*a* of the operation console 6, and a tube current feedback control unit 6*b*12 for feedback-controlling tube current to make the tube current detected value Vc1 detected in the tube current detecting resistor Ridet1 coincide with the tube current set value being set in the operation device 6*a*.

By the tube-voltage control signals generated in the tube voltage feedback control unit 6*b*11, the AD voltage converted into a predetermined frequency in the inverter circuit 2 is stepped up to DC high voltage in the high-voltage generating unit 34 which is formed by the high-voltage transformer 3 and the symmetric Cockcroft-Walton circuit 4. The stepped up high-voltage (tube voltage) is applied between the anode 5*a* and cathode 5*b* of the X-ray tube 5.

At the same time, in a filament heating circuit (not shown) for heating the filament of the X-ray tube 5, the voltage applied to the filament is controlled to a predetermined value by the tube current control signals generated in the tube current feedback control unit 6*b*12. By the application of the controlled voltage to the filament of the X-ray tube 5, the tube current is controlled to be a tube current set value.

Figure 3:
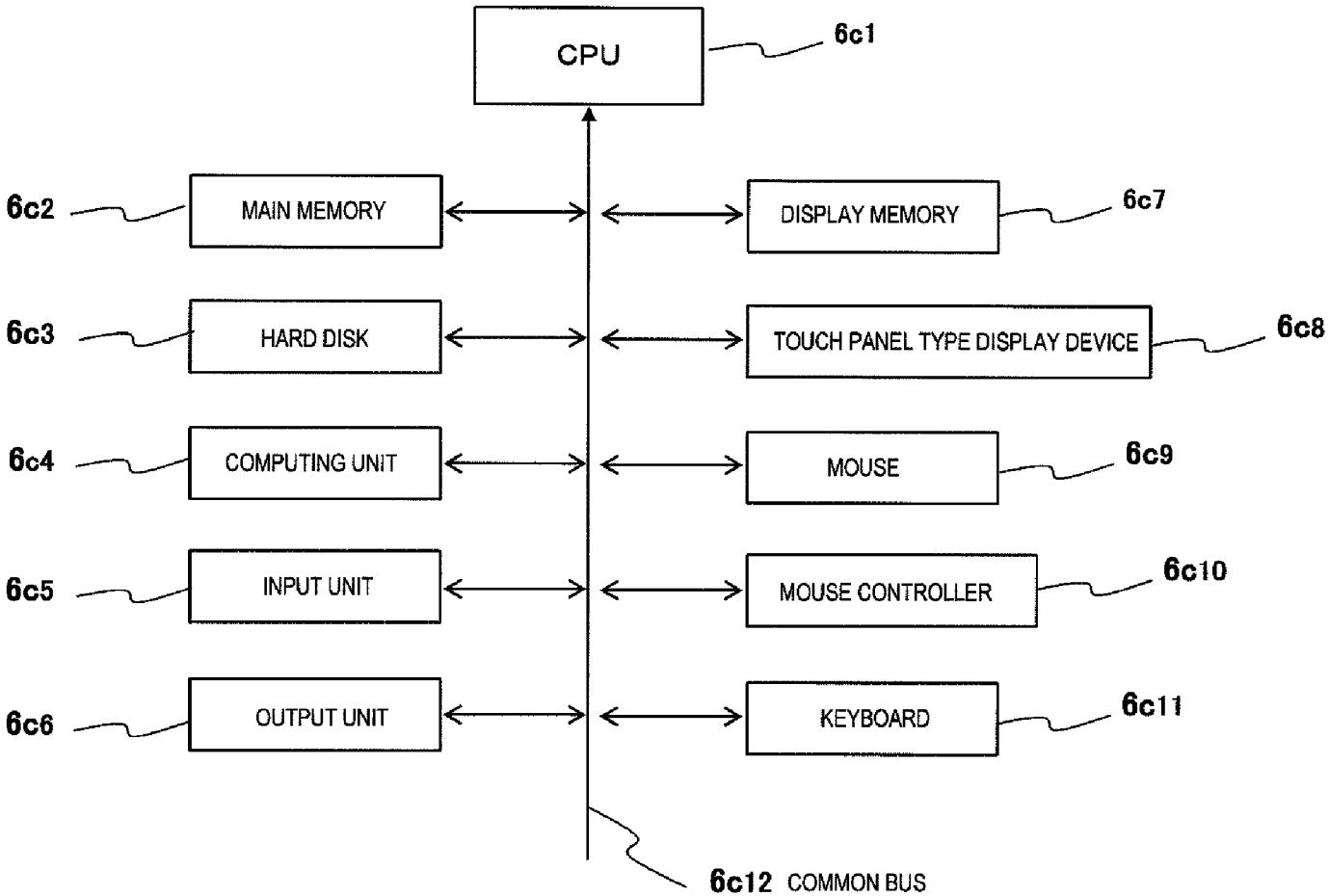
FIG. 3 is a hardware configuration diagram of a microcomputer in an operation console.

As shown in FIG. 3, the operation console 6 comprising the operation device 6*a* and the control device 6*b* comprises a microcomputer formed by:

a central processing unit (CPU) 6*c*1 for controlling operation of the respective components;

a main memory 6*c*2 for storing information such as a control program of the apparatus or data processed in the CPU 6*c*1;

a hard disk 6*c*3 for storing information such as a variety of operation data or programs in advance;

a computing unit 6*c*4 for performing computation of the tube voltage feedback control signals and the tube current feedback control signals from the X-ray control unit 6*b*1;

an input unit 6*c*5 for receiving the data converted by the converter and various timing signals, etc., which includes devices such as an analogue/digital converter (hereinafter, referred to as an A/D converter) for converting the tube voltage detected value and the tube current detected value, etc. into digital values;

an output unit 6*c*6 including a digital/analogue converter (hereinafter referred to as a D/A converter) for converting the result of computation into analogue values;

a display memory 6*c*7 for temporarily storing display data and image data;

a touch-panel type display device 6*c*8, for example, as a display device for displaying the data from the display memory 6*c*7;

a mouse 6*c*9 for operating a soft switch on the screen of the display device 6*c*8;

a controller 6*c*10 for the mouse 6*c*9;

a keyboard 6*c*11 comprising a key or a switch for setting various parameters; and a common bus 6*c*12 for connecting the above respective components.

In such configured microcomputer, high-speed calculateion of the tube voltage feedback control and the tube current feedback control is performed in the computing unit 6*c*4, and the other calculation and a variety of processing is performed in the central processing unit (CPU) 6*c*1.

In the X-ray generator configured as above, the discharge detecting unit 6*b*2 which is a substantial part of the present invention identifies where in the high-voltage generating unit 34 or the anode-earthed type X-ray tube 5 a discharge is generated, as to be described below.

First, when a discharge occurs in the X-ray tube 5, the space between the anode 5*a* and cathode 5*b* of the X-ray tube becomes short-circuit state, and the discharging current thereof is detected in the tube current detecting resistor Ridet1.

However, when a discharge occurs in a place other than the X-ray tube 5 such as the high-voltage transformer 3 or the symmetric Cockcroft-Walton circuit 4, the discharging current can not be detected in the Vc1 since it does not pass through the tube current detecting resistor Ridet1.

On the other hand, in the output voltage (tube voltage) of the symmetric Cockcroft-Walton circuit 4, the terminal voltage of the tube voltage detecting resistor Rvdet_L for detecting the tube voltage drastically decreases no matter where a discharge occurs.

In this way, since the tube voltage which is the output voltage of the high-voltage generating unit 34 to be detected by the tube voltage detecting resistor Rvdet_L gets drastically decreased no matter where a discharge occurs and the tube current to be detected in the tube current detecting resistor Ridet1 drastically increases only when a discharge occurs in the X-ray tube, it is possible to identify whether the discharge occurred in the X-ray tube 5 or in a place other than the X-ray tube 5 by monitoring voltage of both terminals in the tube current detecting resistor Rvdet_L and the tube current detecting resistor Ridet1.

Figure 4:
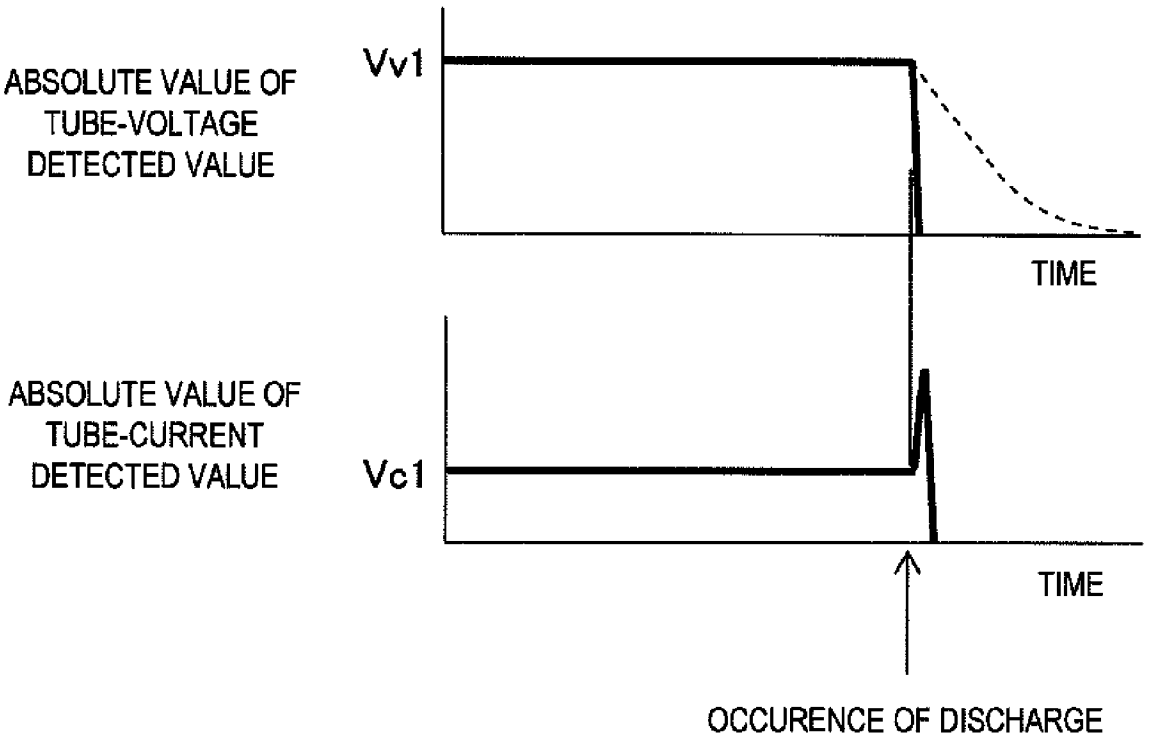
FIG. 4 illustrates the variation state of tube voltage and tube current before and after generation of discharge.

FIG. 4 shows the variation state of the tube voltage (voltage Vv1 of the terminal V1) and the tube current (voltage Vc1 of the terminal C1) before and after a discharge.

While both of the Vv1 and Vc1 in FIG. 1 are negative values since the X-ray tube 5 used in the present embodiment is the anode-earthed type, the absolute values thereof are shown in FIG. 4 to make them easily comprehensive.

As previously described, the tube voltage detected value Vv1 drastically decreases when a discharge occurs somewhere. In contrast, when the operation of the X-ray generator is stopped by stopping the operation of the inverter circuit 2 during a normal performance without occurence of discharge, the tube voltage decreases more moderately than upon discharge as shown in a dotted line since it takes time for the discharge in the capacitor of the high-voltage cable connected to the cathode side of the X-ray tube 5, Cockcroft-Walton circuit, etc.

In other words, there is a difference in slope of decrease in the tube voltage between the slope upon discharge and the slope when the operation of the inverter circuit 2 is stopped during normal performance.

Given this factor, by comparing the slope of decrease in the tube voltage, it is possible to sufficiently identify whether the tube voltage decreased by stopping the operation of the X-ray generator during normal performance or the decrease is due to occurence of a discharge.

In this way, when the tube voltage detected value Vv1 drastically decreases, it is apparent that a discharge occurred in the high-voltage generating unit 34 or the X-ray tube 5.

Further, while the tube current detected value Vc1 drastically increases only when a discharge occurs in the X-ray tube 5, when a discharge occurs in the high-voltage generating unit 34 the Vc1 does not increase drastically since the discharging current thereof does not pass through the Ridet1.

Therefore, a discharging part can be identified by determining that the discharge occurred in the X-ray tube when the tube voltage detected value Vv1 drastically decreases and the tube current detected value Vc1 drastically increases, and that the discharge occurred in a place other than the X-ray tube when the tube current detected value Vv1 drastically decreases and the tube current detected value Vc1 does not increase drastically.

Drastic decrease of the tube voltage detected value Vv1 is determined by comparing with an acceptable value of the slope of tube voltage decrease stored in advance in a hard disk 6*c*3 (shown in FIG. 3), and drastic increase of the tube current detected value Vc1 is determined in the same manner by comparing with an acceptable value of the tube current increase stored in advance in the hard disk 6*c*3.

Figure 5:
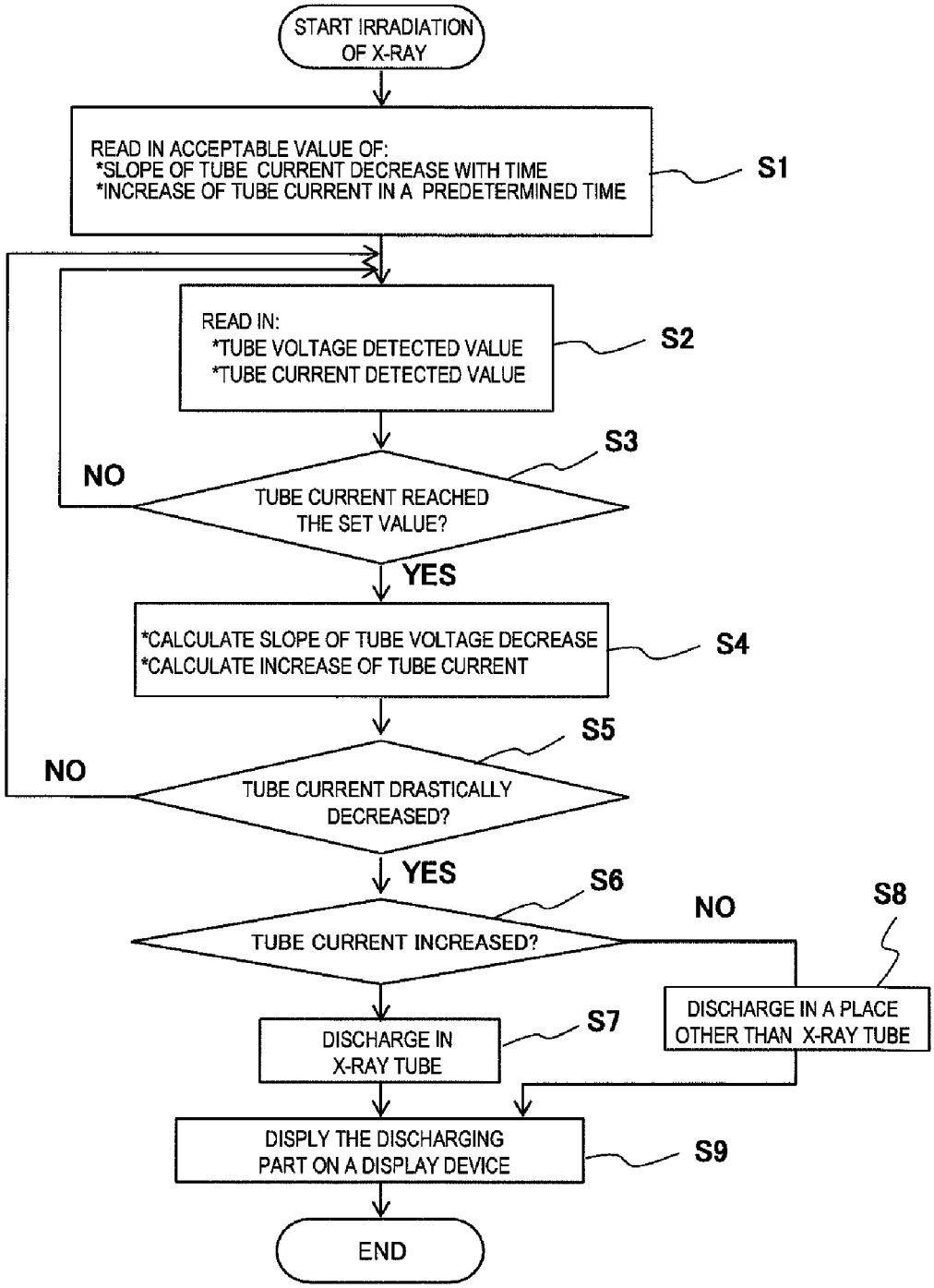
FIG. 5 is a flowchart of the operation for identifying a discharging part.

FIG. 5 is a flowchart of the operation for identifying a discharging part performed in a discharge detecting unit 6*b*2. The discharge detecting unit 6*b*2 is configured by software based on the flowchart and hardware of the operation console 6 in FIG. 3 (discharge portion identifying means). The result of identification of the discharging part is displayed on a display device 6*c*8. The operation will be described below in detail.

(1) A scanning preparation signal is inputted from the operation console 6. A filament of the cathode 5*b* of the X-ray tube 5 is heated based on the input value, and the rotary anode of the X-ray tube 5 is rotated at high velocity. The scanning preparation is completed when the temperature in the filament of the X-ray tube 5 and the rotation number of the rotary anode reach predetermined values. When an scan-starting signal is inputted, high voltage is applied between the anode 5*a* and cathode 5*b* of the X-ray tube 5, an X-ray is irradiated to an object, and an scanning is started.

(2) The acceptable value of the slope with time of the tube voltage decrease stored in advance in the hard disk 6*c*3 (shown in FIG. 3) and the acceptable value of the increase of the tube current in a predetermined time are read in, and stored in a main memory 6*c*2 (shown in FIG. 3) (step S1).

(3) The tube voltage detected value Vv1 (the terminal voltage of the tube voltage detecting resistor Rvdet_L) and the tube current detected value Vc1 (the terminal voltage of the tube current detection resistor Ridet1) are converted into digital values in the A/D converter of the input unit 6*c*5 (shown in FIG. 3), and stored in the main memory 6*c*2 (step S2).

(4) The tube voltage detected value Vv1 read in step S2 and the tube voltage set value being set by the input device (a mouse 6*c*9 or a keyboard 6*c*11, etc. in FIG. 3) are compared in the CPU 6*c*1 (shown in FIG. 3), and determined whether the tube voltage detected value Vv1 reached the tube voltage set value.

When the tube voltage detected value Vv1 reaches the tube voltage set value the next step S4 is carried out, and when the tube voltage detected value Vv1 is not reached the tube voltage set value the process returns to step S2 (step S3).

(5) By dividing the difference between the tube voltage detected value read in the previous time and the tube voltage detected value read in the present time by the reading time intervals (sampling cycle) of the tube voltage detected value, the slope of the tube voltage decrease with time is calculated (tube voltage decrease slope detecting means) in the CPU 6*c*1. Also, the difference between the tube current detected value read in the previous time and the tube current detected value read in the present time is calculated as the tube current increase in the CPU 6*c*1 (tube current increase value detecting means). These calculated values are stored in the main memory 6*c*2 (step S4).

(6) The slope of the tube voltage decrease calculated in step S4 and the acceptable value of the slope of the tube voltage decrease read in step S1 are compared. When the slope of the tube voltage decrease is less than the acceptance value thereof the process returns to step S2, and when the slope of the tube voltage decrease is more than the acceptance value thereof the next step S6 is carried out (step S5, first judging means).

(7) The tube current increase within a predetermined time calculated in step S4 and the acceptance value of the tube current increase thereof are compared (step S6). When the tube current increase within the predetermined time is more than the acceptance value the determination is to be made that the discharge occurred in the X-ray tube (step S7), and when the tube current increase within the predetermined time is less than the acceptance value the determination is to be made that the discharge occurred in a place other than the X-ray tube (step S8, second judging means), whereby the discharging part can be thus identified (discharge portion identifying means).

(8) The identified discharging part is performed with display control in the CPU 6*c*1 (discharge portion display control means), stored in the display memory 6*c*7 (shown in FIG. 3) and displayed on a touch panel display device 6*c*8 (shown in FIG. 3) (step S9, display means).

In this manner, a discharging part can be identified by the first embodiment of the present invention as described, and the X-ray generator can be used efficiently by displaying the identified the discharge portion on the display means as information to an operator or a maintenance division for speedy response to the discharging problem.

Also, for example, the historical trail of a discharge can be stored in the hard disk 6*c*3 as a memory unit in the X-ray generator (discharge history storing means), read out and display controlled (discharge history reading/controlling means) upon a maintenance check, and the display controlled history trail of discharge can be displayed on the touch panel display device 6*c*8.

In this manner, in such case that frequent discharge occurrence is found from the discharge history trail upon maintenance check, it is possible to avoid discontinuation of examination and the burden placed on an object because of the discontinuation due to discharge occurence during the examination can be avoided by organizing operations such as aging or exchange of the X-ray tube 5.

Further, when a discharge portion is identified in a place other than the X-ray tube 5, it is possible to avoid unnecessary exchange of an X-ray tube which is uneconomical due to false recognition that the X-ray tube 5 is deteriorated. When a discharging part is identified in the high-voltage generating unit, appropriate measure can be taken such as repair or exchange of the equivalent portion.

As stated above, it is possible to provide a reliable X-ray generator wherein the potential of breakdown is reduced.

Second Embodiment

Figure 6:
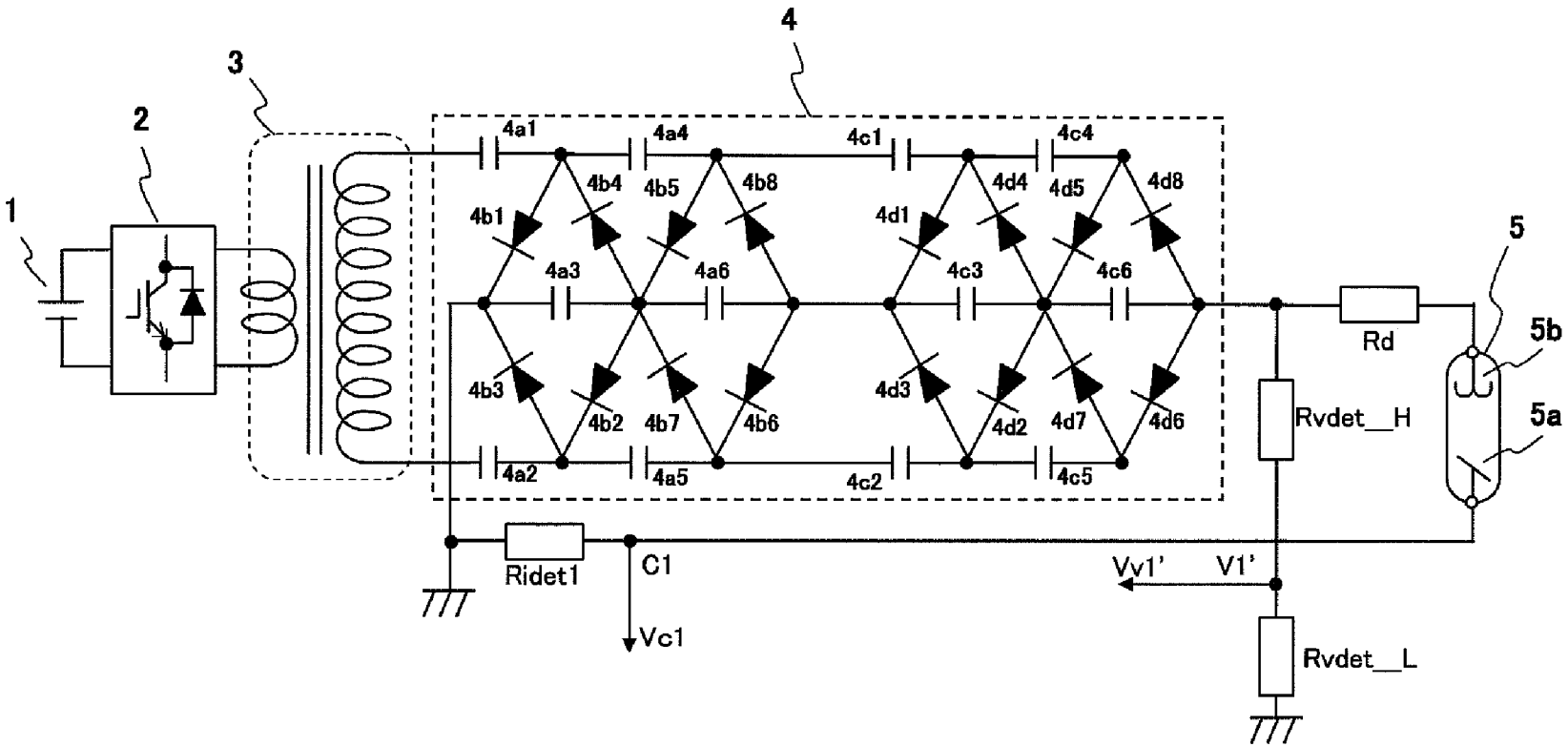
FIG. 6 is a circuitry diagram of second embodiment in the X-ray generator related to the present invention using an anode-earthed type X-ray tube comprising a function for identifying a discharging part.

FIG. 6 is a circuitry diagram of an X-ray generator comprising a function for identifying a discharging part by the second embodiment of the present invention.

A difference of the second embodiment in the X-ray generator from the first embodiment is the position to connect a discharge current suppressing resistor Rd for suppressing discharging current of the X-ray tube 5. More specifically, one end of the series-connected resistor Rvdet_H and resistor Rvdet_L is connected to a negative terminal on the DC output side of the symmetric Cockcroft-Walton circuit 4, and a discharge current suppressing resistor Rd is connected between the connection point thereof and the cathode 5*b* of the X-ray tube 5.

In the first embodiment, the discharge current suppressing resistor Rd is connected between the resistor Rvde_H on the high-voltage side of the tube current detecting circuit and the negative terminal on the DC output side of the symmetric Cockcroft-Walton circuit 4. Therefore, when a discharge occurs in the X-ray tube 5, the resistor Rvdet_H of the high-voltage side becomes the ground potential and the negative terminal on the DC output side of the symmetric Cockcroft-Walton circuit 4 becomes a tube voltage, which generates a high-voltage difference in electric potential equivalent to tube voltage between the symmetric Cockcroft-Walton circuit 4 and the resistor Rvdet_H on the high-voltage side.

For this reason, an electrical insulation for withstanding the above-mentioned difference in electric potential is necessary between the symmetric Cockcroft-Walton circuit 4 and the resistor Rvdet_H on the high-voltage side of the tube voltage detecting circuit.

This insulation can be carried out by keeping a distance between the symmetric Cockcroft-Walton circuit 4 and the resistor Rvdet_H on the high-voltage side, or if it is difficult to keep the distance between them, the resistor Rvdet_H on the high-voltage side needs to be insulated using an oil-impregnated paper, etc.

On the contrary, in the second embodiment, since the tube voltage detecting circuit is directly provided on the negative output side of the symmetric Cockcroft-Walton circuit 4, there is no difference in electric potential between the symmetric Cockcroft-Walton circuit 4 and the resistor Rvdet_H on the high-voltage side of the tube voltage detecting circuit even when a discharge occurs in the X-ray tube 5.

Therefore, electrical insulation as described in the first embodiment is not necessary between the symmetric Cockcroft-Walton circuit 4 and the resistor Rvdet_H on the high-voltage side of the tube voltage detecting circuit, which makes it possible to miniaturize the device compared to the first embodiment.

The actual tube voltage to be applied to the X-ray tube 5 in the second embodiment of the present invention is lower than the voltage decrease portion which is equivalent to the multiplication of the tube current and the discharge current suppressing resistor Rd compared to the output voltage of the symmetric Cockcroft-Walton circuit 4. It means that the voltage obtained based on the voltage dividing ratio of the tube voltage detecting resistors Rvdet_H and the Rvdet_L from the detected value Vv1' of the tube voltage detecting circuit and the voltage to be actually applied to the X-ray tube 5 are different.

Therefore, the actual tube voltage applied to the X-ray tube 5 can not be matched with the tube voltage set value due to the error caused in the tube voltage set value in the tube voltage feedback control and the voltage obtained from the detected value Vv1'.

Given this factor, in order to solve this problem, means to correct the error (tube voltage detected value correcting means) shown in FIG. 7~FIG. 10 is provided in the second embodiment of the present invention.

Figure 7:
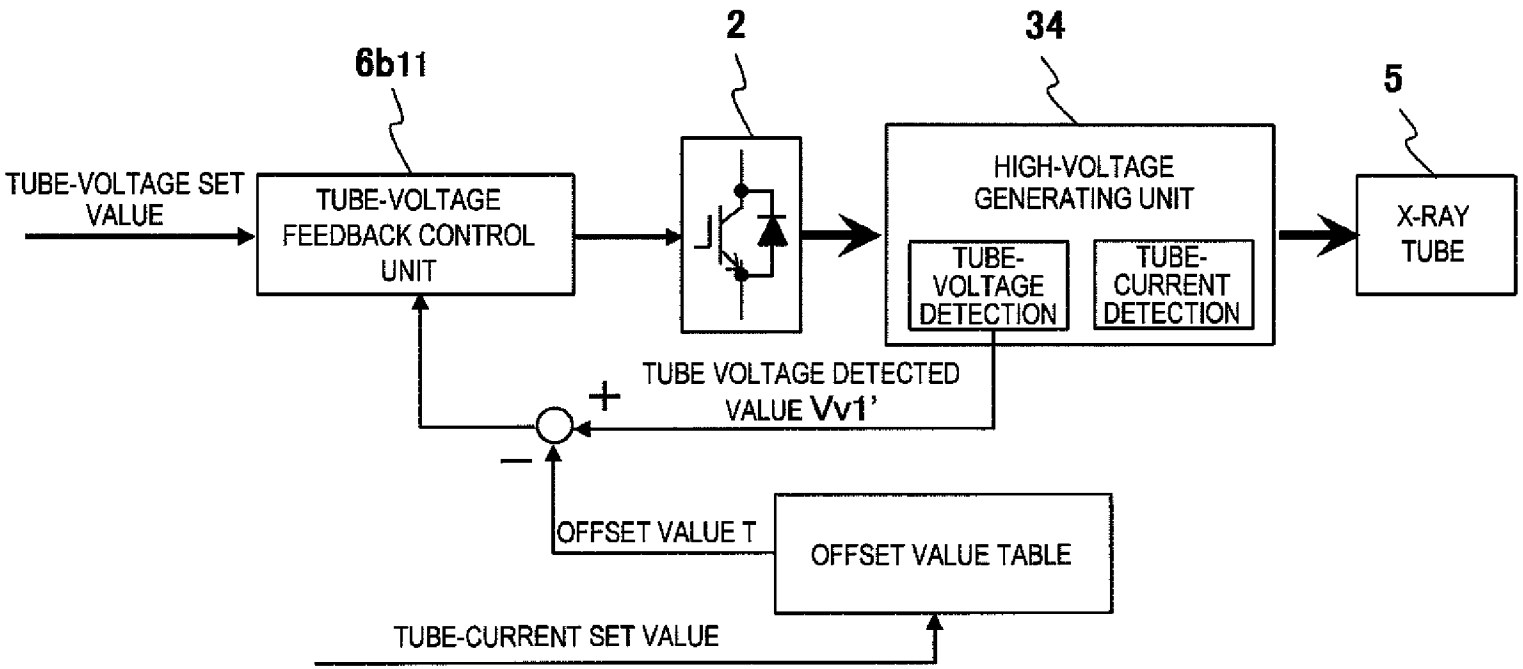
FIG. 7 is a block diagram of a first tube voltage control circuit for feedback controlling tube voltage by correcting tube voltage detection error due to voltage decrease of a discharge current suppressing resistor in the second embodiment.

In the tube voltage feedback control of the second embodiment shown in FIG. 7, the voltage decrease portion which is equivalent to the multiplication of the tube current and the discharge current suppressing resistor Rd is set as an offset value T, and the value wherein the offset value T is subtracted from the tube voltage detected value Vv1' (terminal voltage of the tube voltage detecting resistor Rvdet_L) is set as the corrected tube voltage value which is to be returned to the tube voltage feedback control unit 6*b*1.

As for the offset value T, the relationship between the tube current set value and the voltage decrease portion in the discharge current suppressing resistor Rd by the set tube current is stored in the hard disk 6*c*3 (shown in FIG. 3) in advance as an offset value table.

Then the offset value is read out from the hard disk 6*c*3 to the main memory 6*c*2 (shown in FIG. 3) in advance, and the actual tube voltage detected value Vv1' is corrected using the offset value T corresponding to the tube current set value, when the tube voltage feedback control is carried out.

Figure 8:
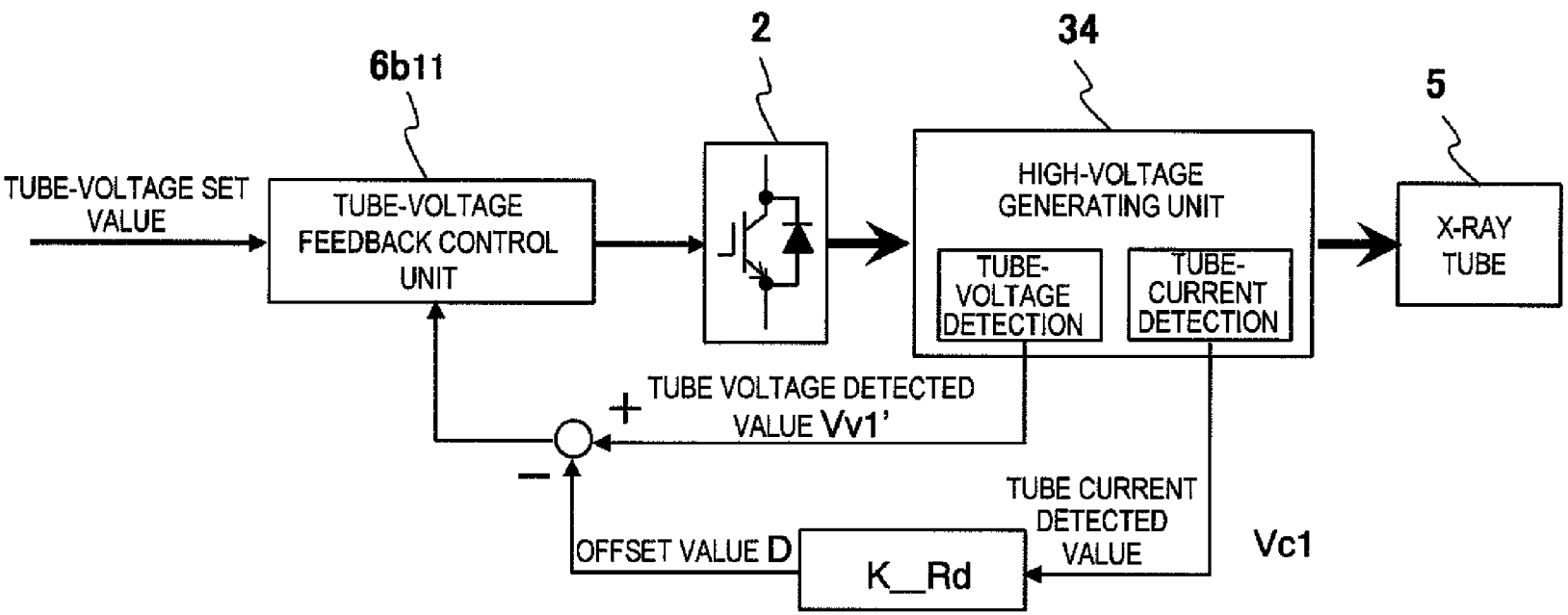
FIG. 8 is a block diagram of second tube voltage control circuit for feedback controlling voltage by correcting the tube voltage detection error due to voltage decrease of a discharge current suppressing resistor in the second embodiment.

FIG. 8 is a variation example of FIG. 7 which obtains the offset value of the voltage decrease portion of the discharge current suppressing resistor Rd using the actual tube current detected value (terminal voltage Vc1 of the tube current detecting resistor Ridet1 shown in FIG. 8). In the tube voltage feedback control shown in FIG. 8, the value wherein the tube current detected value is multiplied by the gain K_Rd which is equivalent to the discharge current suppressing resistor Rd is set as the offset value D, and the value wherein the offset value D is subtracted from the tube voltage detected value Vv1' is returned to the tube voltage feedback control unit 6*b*11.

The gain K_Rd for obtaining the offset value D is set to make the offset value D to be the same value as the offset T in FIG. 7, and is constant without depending on the tube current value.

In accordance with the variation example shown in FIG. 8, since the offset value D is obtained by the actual tube current, it is possible to control tube voltage more accurately even when the tube current set value and the actual tube current value are different, without being influenced by the difference. Also, since there is no need to prepare an offset value table as in FIG. 7, the configuration of means for obtaining the offset value becomes simple.

Figure 9:
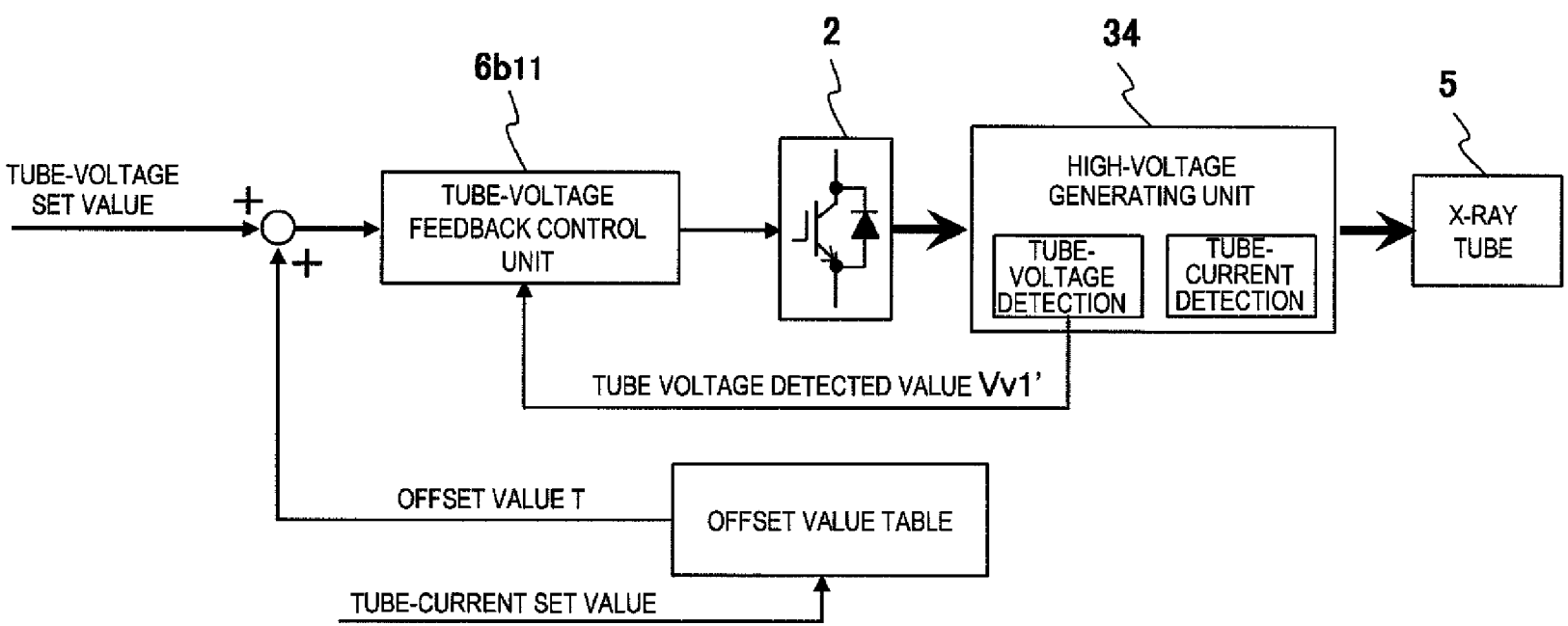
FIG. 9 is a block diagram of a third tube voltage control circuit for feedback controlling voltage by correcting the tube voltage detection error due to voltage decrease of a discharge current suppressing resistor in the second embodiment.
Figure 10:
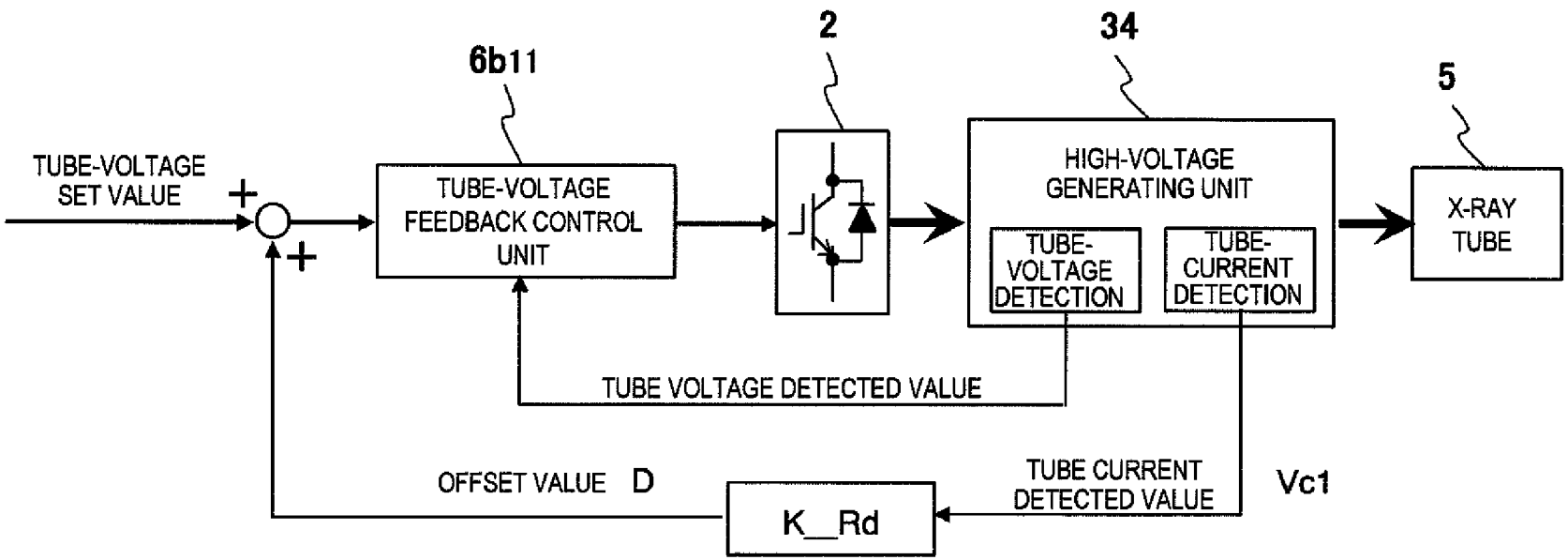
FIG. 10 is a block diagram of a fourth tube voltage control circuit for feedback controlling voltage by correcting the tube voltage detection error due to voltage decrease of a discharge current suppressing resistor in the second embodiment.

While FIG. 7 and FIG. 8 are examples for performing tube voltage feedback control by subtracting the offset value T or offset value D respectively from the tube voltage detected value, the method may also be performed by adding the offset value T or offset value D respectively to the tube voltage set value. FIG. 9 is a variation example of FIG. 7 wherein an offset value T is obtained using an offset value table and the obtained offset value T is added to the tube voltage set value, and FIG. 10 is a variation example of FIG. 8 wherein an offset value D is obtained by multiplying the tube current detected value by a gain K_Rd and the obtained offset value D is added to the tube voltage set value. In this manner, even by adding the offset value T or the offset value D to the tube voltage set value for correction, the same effect can be gained as the examples in FIGS. 7 and 8.

In accordance with the second embodiment, since the feedback control of tube voltage is performed by correcting tube voltage detected value, it is possible to accurately perform feedback control on tube voltage even when the resistor Rvdet_H and resistor Rvdet_L for detecting the tube voltage is connected in parallel with the high voltage generating circuit. Also, The X-ray generator can be more miniaturized than the one in the first embodiment since there is no need to insulate the tube voltage detecting circuit formed by the tube voltage detecting resistors Rvdet_H and Rvdet_H with respect to the high-voltage terminal side.

As described above, a tube voltage detecting error which is equivalent to the voltage decrease portion due to discharge current suppressing resistor can be corrected by correcting the tube voltage detected value or the tube voltage set value, whereby preventing the lowering of accuracy in tube voltage feedback control.

Third Embodiment

Figure 11:
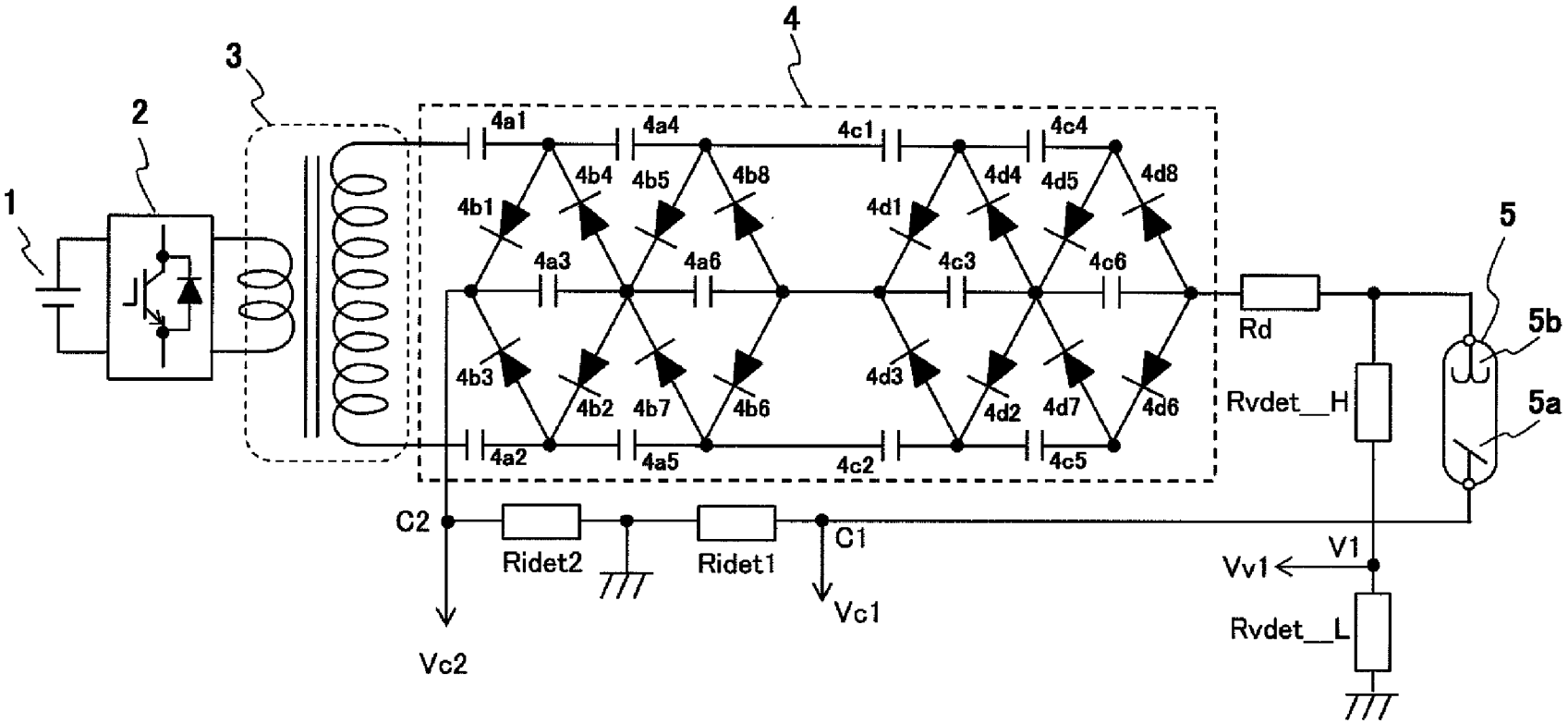
FIG. 11 is a circuitry diagram of third embodiment of the X-ray generator related to the present invention using an anode-earthed type X-ray tube comprising a function for identifying a discharging part.

FIG. 11 is a circuitry diagram of the third embodiment in the X-ray generator of the present invention comprising a function for identifying a discharging part.

This X-ray generator further comprises a resistor Ridet2 between the positive terminal of DC output voltage of the symmetric Cockcroft-Walton circuit 4 in the first embodiment shown in FIG. 1, and the earth. As a result of detecting a voltage decrease Vc2 of the resistor Ridet2 in addition to the detection of the voltage descent Vv1 of the tube voltage detecting resistor Rvdet_L and the voltage decrease Vc1 of the tube current detecting resistor Ridet1, the difference to be caused in variation of the Vv1, Vc1 and Vc2 depending on a discharge generating portion will be described below.

When a discharge occurs in the X-ray tube 5, the Vv1 drastically decreases, and the Vc1 and Vc2 drastically increases.

On the other hand, when a discharge occurs on the DC output side of the symmetric Cockcroft-Walton circuit 4 which is the high-voltage generating unit, the Vv1 drastically decreases and the Vc2 drastically increases, but there is no major variation in the Vc1.

Further, when a discharge occurs, for example, on both sides of one capacitor in the symmetric Cockcroft-Walton circuit 4 the Vv1 drastically decreases only for the voltage portion corresponding to the discharging part, but when a discharge is not in response to the earth there is no major change in Vc1 and Vc2 since the discharging current does not pass through the Ridet1 and Ridet2.

As stated above, since the variation of Vv1, Vc1 and Vc2 are respectively different depending on the place where a discharge occurs, condition of the discharge occurence can be identified more particularly by capturing the variation characteristics of the Vv1, Vc1 and Vc2, whereby identification of a discharging part can be performed more precisely than the first embodiment and the second embodiment by analyzing the characteristic of the Vv1, Vc1 and Vc2.

Fourth Embodiment

While the above-described embodiments are the case of the X-ray generator using an anode-earthed type X-ray tube, the description herein of specific embodiments is not intended to limit the present invention to the particular forms described, and can also be applied to the X-ray generator using a cathode-earthed type X-ray tube wherein the cathode is earthed.

Figure 12:
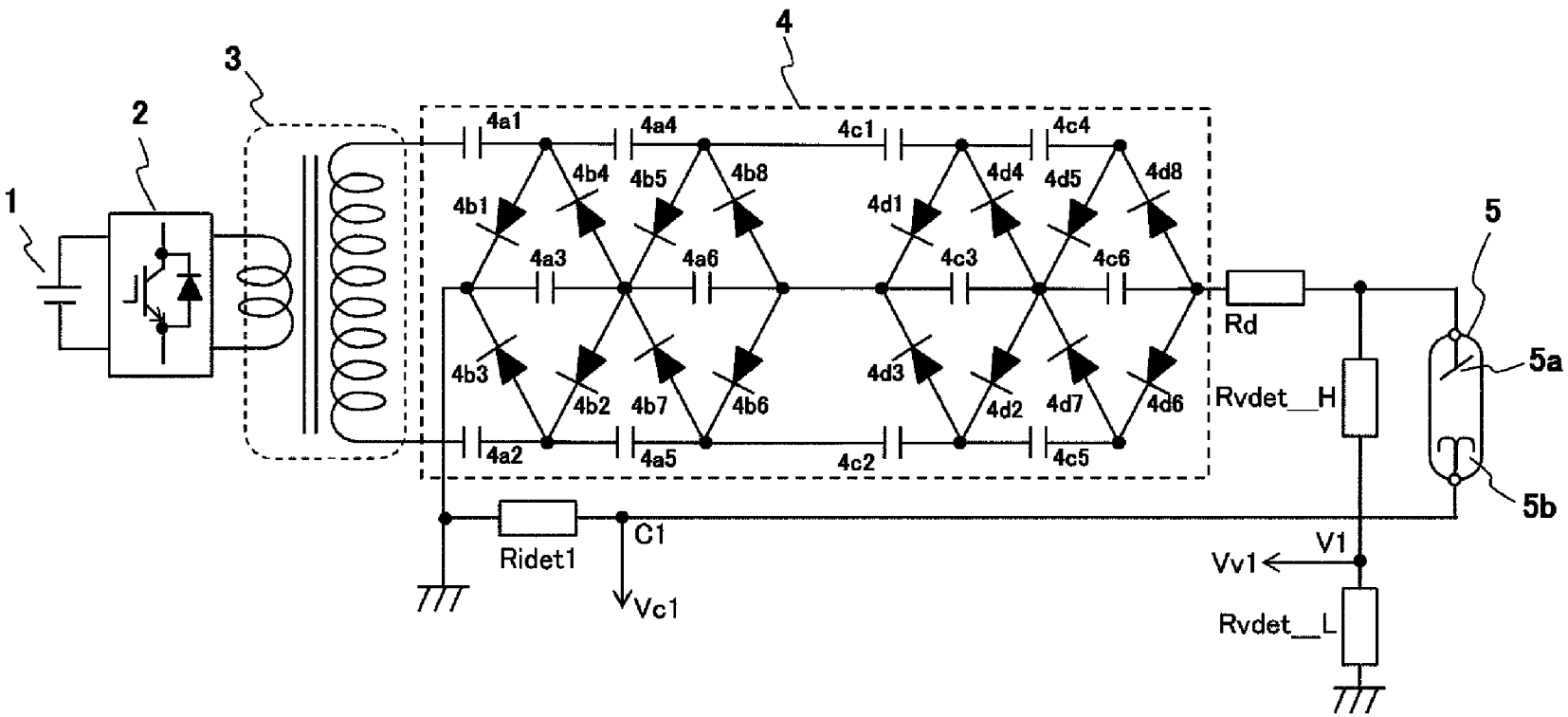
FIG. 12 is a circuitry diagram of fourth embodiment of the X-ray generator related to the present invention using an anode-earthed type X-ray tube comprising a function for identifying a discharging part.

FIG. 12 is a circuitry diagram of fourth embodiment in the X-ray generator of the present invention comprising a function for identifying a discharging part when the cathode of the X-ray tube is earthed.

In FIG. 12, an anode 5*a* of the X-ray tube 5 is connected to the positive terminal of DC output voltage of the symmetric Cockcroft-Walton circuit 4 via the discharge current suppressing resistor Rd, and the negative terminal of DC output voltage of the symmetric Cockcroft-Walton circuit 4 is earthed. The resistors Rvdet_H and Rvdet_L for detecting the tube voltage is connected between the connecting point of the discharge current suppressing resistor Rd and the anode 5*a* of the X-ray tube 5, and the earth, and the terminal voltage Vv1 of the resistor Rvdet_L is detected as the tube voltage detected value. The resistor Ridet1 for detecting the tube current is connected between the cathode 5*b* of the X-ray tube 5 and the earth, and the terminal voltage Vc1 of the resistor Ridet1 is detected as the tube current detected value.

The discharging part of the X-ray generator by such configured fourth embodiment related to the present invention can be identified by the same concept as the first embodiment.

More specifically, when a discharge occurs in the X-ray tube 5, short-circuit state is caused between the anode 5*a* and the cathode 5*b* of the X-ray tube 5, and the discharging current flows through the tube current detecting resistor Ridet1 and a drastic variation is generated in the terminal voltage Vc1. However, when a discharge occurs in a place other than the X-ray tube 5 such as the high-voltage transformer 3 or the symmetric Cockcroft-Walton circuit 4, the discharging current does not flow through the tube current detecting resistor Ridet1 thus no variation takes place in the Vc1.

On the other hand, in the output voltage (tube voltage) of the symmetric Cockcroft-Walton circuit 4, wherever a discharge occurs the terminal voltage Vv1 of the tube voltage detecting resistor Rvdet_L for detecting the tube voltage drastically decreases.

As described above, the terminal voltage Vv1 drastically decreases regardless of the place where a discharge occurs and the terminal voltage Vc1 drastically increases only when a discharge occurs in the X-ray tube, it is possible to identify whether the discharge occurred in the X-ray tube 5 or the place other than the X-ray tube 5 by monitoring the terminal voltages Vv1 and Vc1.

Also, since the X-ray generator using the cathode-earthed type X-ray tube has the tube wherein the cathode thereof is earthed, there is no need to provide the high-voltage insulation transformer of the filament heating circuit (not shown) for heating the cathode filament, whereby the X-ray generator which is small in size and moderate in price can be provided.

In addition, while the above-described fourth embodiment of FIG. 12 is an example of applying the concept of the embodiment in FIG. 1 to the X-ray generator using the cathode-earthed type X-ray tube, it also is possible to apply the function for correcting the tube voltage control error in the second embodiment shown in FIG. 6, the second embodiment shown in FIG. 7, FIG. 8, FIG. 9 and FIG. 10 and the concept of the third embodiment shown in FIG. 11 in the same manner.

Therefore, the X-ray generator of the present invention is capable of identifying a discharging part by applying to an X-ray generator using an X-ray tube of either type of the anode-earthed type X-ray tube wherein the anode is earthed as an X-ray source or the cathode-earthed type X-ray tube wherein the cathode is earthed.

While the respective embodiments are described above using FIG. 1~FIG. 12, the description herein of specific 32 embodiments is not intended to limit the present invention to the particular forms described.

For example, the circuit for stepping up the output voltage of the high-voltage transformer to double the voltage does not have to be limited to the symmetric type Cockcroft-Walton circuit using the full-wave rectifying circuit, and the other types of Cockcroft-Walton circuit or any other circuit other than the Cockcroft-Walton circuit that steps the voltage up to double the voltage may be applied.

Also, the full-wave rectifying circuit used for the Cockcroft-Walton circuit is explained using the example that four groups are series-connected, the number of groups to be series-connected does not have to be limited to four. If the number of groups to be connected in series is small the electric power can be supplied in high speed, and if the number of groups is large the turn ratio of the transformer in the former-stage can be made smaller whereby the transformer can be miniaturized.

INDUSTRIAL APPLICABILITY

The present invention is to be applied to an X-ray generator using one-side earthed type X-ray tube wherein the anode or cathode is earthed. Taking advantage of each of the types of X-ray tube, the X-ray generator using the anode-earthed type X-ray tube is to be applied mainly for medical use wherein large heat capacity is demanded, and the X-ray generator using the cathode-earthed type X-ray tube is to be applied mainly for industrial use wherein small heat capacity is sufficient.

The invention claimed is:

1. An X-ray generator comprising:

a one-side earthed type X-ray tube wherein anode or cathode is earthed;

high-voltage generating means for generating X-rays by applying DC high-voltage between the anode and cathode of the X-ray tube;

a power source for providing electric power to the high-voltage generating means;

a discharge current suppressing resistor connected between one end of DE output of the high-voltage generating means and the anode or cathode on the side that the one-side earthed type X-ray tube is not earthed, for suppressing discharging current of the one-side earthed type X-ray tube;

tube voltage detecting means for detecting tube voltage applied between the anode and the cathode of one-side earthing X-ray tube;

tube current detecting means for detecting tube current flows between the anode and the cathode of the one-side earthed type X-ray tube;

discharge portion identifying means for identifying, upon occurrence of a discharge in the X-ray generator, where in the high-voltage generating means or the one-side earthed type X-ray tube the discharge occurred based on the tube voltage detected value detected in the tube voltage detecting means and the tube current detected value detected in the tube current detecting means; and display means for displaying the discharging part identified in the discharge portion identifying means.

2. The X-ray generator according to claim 1, wherein the discharge portion identifying means comprises:

tube voltage decrease-slope calculating means for calculating a slope of decrease with time of the tube voltage detected value detected by the tube voltage detecting means;

tube current increase calculating means for calculating increase of the tube current detected value detected in the tube current detecting means in a predetermined time;

first judging means for judging whether or not the slope of the calculated tube voltage decrease calculated in the tube voltage decrease-slope calculating means exceeds its acceptable value, and second judging means for judging whether or not the increase of the calculated tube current calculated in the tube current increase calculating means exceeds its acceptable value, and wherein the discharge portion identifying means identifies where in the high-voltage generating means or the one-side earthed type X-ray tube a discharge occurred based on the judging result of the first judging means and the second judging means.

3. The X-ray generator according to claim 2, wherein:

the tube voltage detecting means is formed by a series-connected first resistor and a second resistor in which one end is connected to the connecting point to the high-voltage generating means of the discharge current suppressing resistor or the connecting point to the cathode or the anode on the side that the one-side earthed type X-ray tube is not earthed and the other end is earthed, wherein tube voltage is to be detected through the voltage decrease in the first resistor or the second resistor; and the tube current detecting means is formed by a third resistor in which one end is connected to the anode or the cathode of the side on which the one-side earthed type X-ray tube is earthed and the other end is earthed, and tube current is detected through the voltage decrease of the third resistor.

4. The X-ray generator according to claim 3, further comprising:

input means for setting tube voltage to be applied to the one-side earthed type X-ray tube and tube current to flow in the one-earthed type X-ray tube;

tube voltage feedback control means for controlling output voltage of the power source so that the tube voltage detected value detected by the tube voltage detecting means is the set value; and tube current feedback control means for controlling output current of the power source so that the tube current detected value detected in the tube current detecting means is the set value.

5. The X-ray generator according to claim 4, wherein the one end of the tube voltage detecting means is connected to the connecting point of the discharge current suppressing resistor and the high-voltage generating means; and wherein the X-ray generator further includes tube voltage detected value correcting means for correcting the voltage decrease in the discharge current suppressing resistor and correcting the tube voltage detected value inputted to the tube voltage feedback control means.

6. The X-ray generator according to claim 5, wherein the tube voltage detected value correcting means comprises:

an offset value table on which the relationship between the tube current set value and the offset value which is equivalent to the voltage decrease by the discharge current suppressing resistor are described; and first subtracting and correcting means for reading out the offset value corresponding to the tube current set value from the offset value table, and correcting the tube voltage detected value by subtracting the read out offset value from the tube voltage detected value.

7. The X-ray generator according to claim 5, wherein the tube voltage detected value correcting means comprises:

offset value calculating means for calculating an offset value by multiplying the tube current detected value detected by the tube current detecting means by a predetermined correction coefficient; and second subtracting and correcting means for correcting the tube voltage detected value by subtracting the offset value calculated by the offset value calculating means from the tube voltage detected value.

8. The X-ray generator according to claim 4, wherein the one end of the tube voltage detecting means is connected to the connecting point of the discharge current suppressing resistor and the high-voltage generating means; and wherein the X-ray generator further includes tube voltage set value correcting means for correcting voltage decrease in the discharge current suppressing means and correcting the set value inputted to the tube voltage feedback control means.

9. The X-ray generator according to claim 8, wherein the tube voltage set value correcting means comprises:

an offset value table on which the relationship between the tube current set value and the offset value which is equivalent to the voltage decrease by the discharge current suppressing resistor are described; and adding and correcting means for reading out the offset value corresponding to the tube current set value from the offset value table and adding it to the tube voltage set value to correct the tube voltage set value.

10. The X-ray generator according to claim 8, wherein the tube voltage set value correcting means comprises:

offset value calculating means for calculating an offset value by multiplying the tube current detected value detected in the tube current detecting means by a predetermined correcting coefficient; and adding and correcting means for correcting the tube voltage set value by adding the offset value calculated in the offset value calculating means to the tube voltage set value.

11. The X-ray generator according to claim 3, further comprising current detecting means in which one end is connected to the other end of the DC output of the high-voltage generating means and the other end is earthed, which is formed by a resistor for detecting output current including tube current from the high-voltage generating means, wherein the discharge portion identifying means further comprises third judging means for judging and identifying a discharging part in the high-voltage generating means based on the waveform of the output current detected by the current detecting means.

12. The X-ray generator according to claim 3, further comprising discharge history storing means for storing historical trail of discharging parts identified by the discharge portion identifying means, wherein the display means displays the discharge trail stored in the discharge trail storing means, in each case as need arises.

13. The X-ray generator according to claim 3, wherein the high-voltage generating means includes:

a high-voltage transformer for stepping up alternating voltage; and high-voltage doubling means for doubling the alternating high-voltage stepped up by the high-voltage transformer and converting the doubled alternating voltage into direct-current high-voltage.

14. The X-ray generator according to claim 13, wherein the high-voltage doubling means is a Cockcroft-Walton circuit configured by series-connecting plural groups of full-wave boost rectifier circuits respectively formed by a full-wave rectifying circuit, a first capacitor connected to the alternating-current input side of the full-wave rectifying circuit and a second capacitor connected to the DC output side of the full-wave rectifying circuit.

15. The X-ray generator according to claim 3, wherein the electric power source includes DC/AC converting means having an power superconductor switching element for converting a DC power source and DC voltage of the DC power source into high-frequency AC voltage.

* * * * *